US005183418A

United States Patent [19]

Yamanashi et al.

[11] Patent Number: 5,183,418

[45] Date of Patent: Feb. 2, 1993

[54] CONNECTOR

[75] Inventors: Makoto Yamanashi; Keishi Jinno; Tamio Watanabe; Takayoshi Endo; Sakai Yagi, all of Shizuoka, Japan

[73] Assignee: Yazaki Corporation, Tokyo, Japan

[21] Appl. No.: 767,947

[22] Filed: Sep. 30, 1991

[30] Foreign Application Priority Data

Oct. 1, 1990 [JP] Japan ..... 2-260629
May 27, 1991 [JP] Japan ..... 3-37485

[51] Int. Cl.[5] ..... H01R 13/436
[52] U.S. Cl. ..... 439/752; 439/595
[58] Field of Search ..... 439/595, 752

[56] References Cited

U.S. PATENT DOCUMENTS

| | | | |
|---|---|---|---|
| 4,891,021 | 1/1990 | Hayes et al. | 439/752 |
| 4,921,448 | 5/1990 | Endo et al. | 439/595 |
| 4,984,998 | 1/1991 | Duncan et al. | 439/752 |
| 5,037,336 | 8/1991 | Betsui | 439/752 |
| 5,057,042 | 10/1991 | Yamanashi et al. | 439/752 |
| 5,059,142 | 10/1991 | Ohta et al. | 439/752 |
| 5,061,210 | 10/1991 | Jimmo | 439/752 |
| 5,066,253 | 11/1991 | Kameyama | 439/752 |
| 5,069,639 | 12/1991 | Kodama et al. | 439/752 |
| 5,071,373 | 12/1991 | Nagasaka et al. | 439/752 |
| 5,071,374 | 12/1991 | Plocek et al. | 439/752 |

FOREIGN PATENT DOCUMENTS

| | | |
|---|---|---|
| 50-113888 | 9/1975 | Japan . |
| 52-120394 | 9/1977 | Japan . |
| 55-48638 | 3/1980 | Japan . |
| 2-34083 | 3/1990 | Japan . |

*Primary Examiner*—Cary F. Paumen
*Attorney, Agent, or Firm*—Sughrue, Mion, Zinn, Macpeak & Seas

[57] ABSTRACT

A connector is made up of a connector housing including terminal accommodating chambers each of which has a first flexible locking piece for locking a metal terminal; and a terminal locking member which is engaged with the connector housing temporarily and finally, and which has second flexible locking pieces provided for locking the metal terminals in the terminal accommodating chambers, respectively. Each of the second flexible locking pieces has a locking protrusion which, when the metal terminal is inserted in a reverse way, is engaged with the protrusion of the metal terminal, or each of the second flexible locking pieces is adapted to push, when the metal terminal is inserted in a reverse way, the metal terminal against the wall of the terminal accommodating chamber, to interrupt the insertion of the metal terminal. Each terminal accommodating chamber may hve a terminal guide to smoothly guide the metal terminal thereinto.

7 Claims, 6 Drawing Sheets

CONNECTOR

BACKGROUND OF THE INVENTION

This invention relates to a connector for connecting, for instance, wire harnesses in a motor vehicle, and more particularly to an improvement of the connector to prevent metal terminals from being inserted into the terminal accommodating chambers of a connector housing upside down, and to prevent the unintentional removal of the metal terminals.

A conventional connector of this type is as shown in FIGS. 9 through 11. In these figures, reference character a designates a connector housing; b, a terminal locking member; and c, a metal terminal. The connector housing a has terminal accommodating chambers $a_1$, in each of which a first flexible locking piece $a_2$ is provided for the metal terminal c. As for each terminal accommodating chamber, the terminal locking member b has a pair of second flexible locking pieces $b_1$.

The terminal locking member b has temporary locking pieces $b_2$ with temporary locking protrusions $b_{2'}$, and a final locking piece $b_3$ with a final locking protrusion $b_{3'}$. These protrusions are engaged with the locking portions of locking frames $a_3$ formed in the connector housing a.

The metal terminal c comprises an electrical contact portion $c_1$, and a wire connecting portion $c_2$. The electrical contact portion has a bottom portion $c_3$, and a pair of stabilizers $c_4$ extended downwardly from the bottom portion $c_3$ to regulate the posture of the metal terminal inserted into the terminal accommodating chamber $a_1$. The terminal locking member b has insertion holes $b_6$ formed in its main frame $b_4$. Passage guide protrusions $b_6$ having smooth guide surfaces $b_{6'}$, which are for instance arcuate in correspondence to the configuration of the bottom portion $c_3$, are formed in the insertion holes $b_3$ of the terminal locking member b. Passage permitting grooves $b_7$ are formed beside the passage guide protrusions $b_6$ in correspondence to the stabilizers $c_4$ of the metal terminals c.

With the temporary locking protrusions $b_{2'}$ temporarily engaged with the locking portions of the locking frame $a_3$, the metal terminal c is inserted into the terminal accommodating chamber $a_1$ through the insertion hole $b_5$ in the main frame $b_4$ of the terminal locking member b. In this operation, the bottom portion $c_3$ abuts against the passage guide protrusions $b_6$; however, it passes over the passage guide protrusions readily because the latter have the smooth guide surfaces $b_{6'}$, while the stabilizers $c_4$ are moved along the passage permitting grooves $b_7$. Thus, the metal terminal can be smoothly inserted into the terminal accommodating chamber $a_1$.

If the metal terminal is erroneously disposed upside down when inserted, then the stabilizers $c_4$ are caused to abut against the upper portion of the main frame $b_4$, thus preventing the metal terminal from being inserted upside down.

The size of the insertion hole b: depends on that of the wire connection portion $c_2$. Therefore, in the case where the wire connecting portion is increased in dimension, it is necessary to increase the amount of protrusion of the stabilizers $c_4$.

In the above-described conventional connector, the stabilizers greatly protruded from the metal terminal are utilized to eliminate the difficulty that the metal terminal is inserted upside down. For instance, when the metal terminal is connected to a wire, the stabilizers thus formed may damage the wire by scratching it.

In order to lock the metal terminal into the terminal accommodating chamber of the connector housing, in general a flexible locking arm is provided on the inner wall of the terminal accommodating chamber. That is, when the metal terminal is inserted into the terminal accommodating chamber, the flexible locking arm thus provided is engaged with the metal terminal so as to prevent the difficulty that the metal terminal is unintentionally removed. Recently, a connector has been proposed in the art in which a terminal locking member is provided behind the connector housing which, together with or instead of the flexible locking arm, acts to positively eliminate the difficulty that the metal terminal is unintentionally removed from the connector (cf. Japanese Utility Patent Application (OPI) No. 34083/1990 (the term "OPI" as used herein means an "unexamined published application").

FIG. 12 shows another example of the conventional connector, which comprises a connector housing a", and a terminal locking member b". In FIG. 12, the terminal locking member b" is temporarily engaged with the connector housing a" (the locking mechanisms of the connector housing and the terminal locking members being is not illustrated).

The connector housing a" has a plurality of terminal accommodating chambers c". Each of the terminal accommodating chambers c" has a flexible locking piece e" for locking a metal terminal d" in correspondence to the respective terminal accommodating chamber c", and a terminal retaining piece g" which is in the respective terminal accommodating chamber c".

The connector thus constructed is used as follows: That is, with the terminal locking member b" temporarily engaged with the connector housing a", the metal terminal d" is inserted into the terminal accommodating chamber c" through the insertion hole f". In this operation, as shown in the upper half of FIG. 13, the metal terminal d" is inserted while flexing the terminal retaining piece g" which is in its way, and the flexible locking piece e" is then deflected. When the metal terminal has been fully inserted, the flexible locking piece e" is restored to lock the metal terminal d". Thereafter, the terminal locking member b" is inserted into the connector housing a"; that is, the terminal locking member b" is completely engaged with the connector housing a". As a result, the terminal retaining piece g" also locks the metal terminal d", thus preventing the unintentional removal of the metal terminal d". The connector thus constructed is disadvantageous in the following point. As shown in FIG. 12, a gap m is provided between the terminal locking member b" and the partition wall h" between the upper and lower terminal accommodating chambers c" and c". Therefore, if the metal terminal d" is slightly inclined as shown in the lower half of FIG. 13 When inserted, then the end $d''_1$ will strike against the rear end $h''_1$ of the partition wall h", thus obstructing the smooth insertion of the metal terminal.

SUMMARY OF THE INVENTION

In view of the foregoing, an object of this invention is to provide a connector in which the difficulty that the metal terminal is inserted upside down is prevented without provision of large protrusions such as stabilizers.

Another object of the invention is to provide a connector in which, even when the terminal locking member is temporarily engaged with the connector housing, the metal terminal can be smoothly inserted into the connector housing.

The foregoing ojjects and other objects of the invention have been achieved by the provision of the following connectors:

An example of a connector provided according to the invention comprises: a connector housing including terminal accommodating chambers each of which has a first flexible locking piece for locking a metal terminal; and a terminal locking member which is movably engaged with the connector housing in two steps, temporarily and finally, and which has second flexible locking pieces provided for locking the metal terminals in the terminal accommodating chambers, respectively. Each of the second flexible locking pieces has a locking protrusion at the free end which, when the metal terminal is inserted upside down, is engaged with an inverted-insertion preventing protrusion formed on the metal terminal, or each of the second flexible locking pieces is adapted to push, when the metal terminal is inserted upside down, the metal terminal against the wall of the terminal accommodating chamber, to cause the end portion of the metal terminal to abut against a locking step formed on the wall of the terminal accommodating chamber.

Another example of the connector according to the invention comprises: a connector housing having terminal accommodating chambers;metal terminals which are to be inserted into said terminal accommodating chambers; and a terminal locking member which is engaged with said connector housing in two steps, temporarily and finally. The connector housing includes terminal guide pieces formed on a partition wall which divides the terminal accommodating chambers into upper and lower terminal accommodating chambers, and the terminal guide pieces are adapted to guide metal terminals into the terminal accommodating chambers, respectively.

The nature, principle and utility of the invention will become more apparent from the following detailed description when read in conjunction with the accompanying drawings.

DETAILED DESCRIPTION OF THE INVENTION

Preferred embodiments of this invention will be described with reference to the accompanying drawings.

Figure 1:
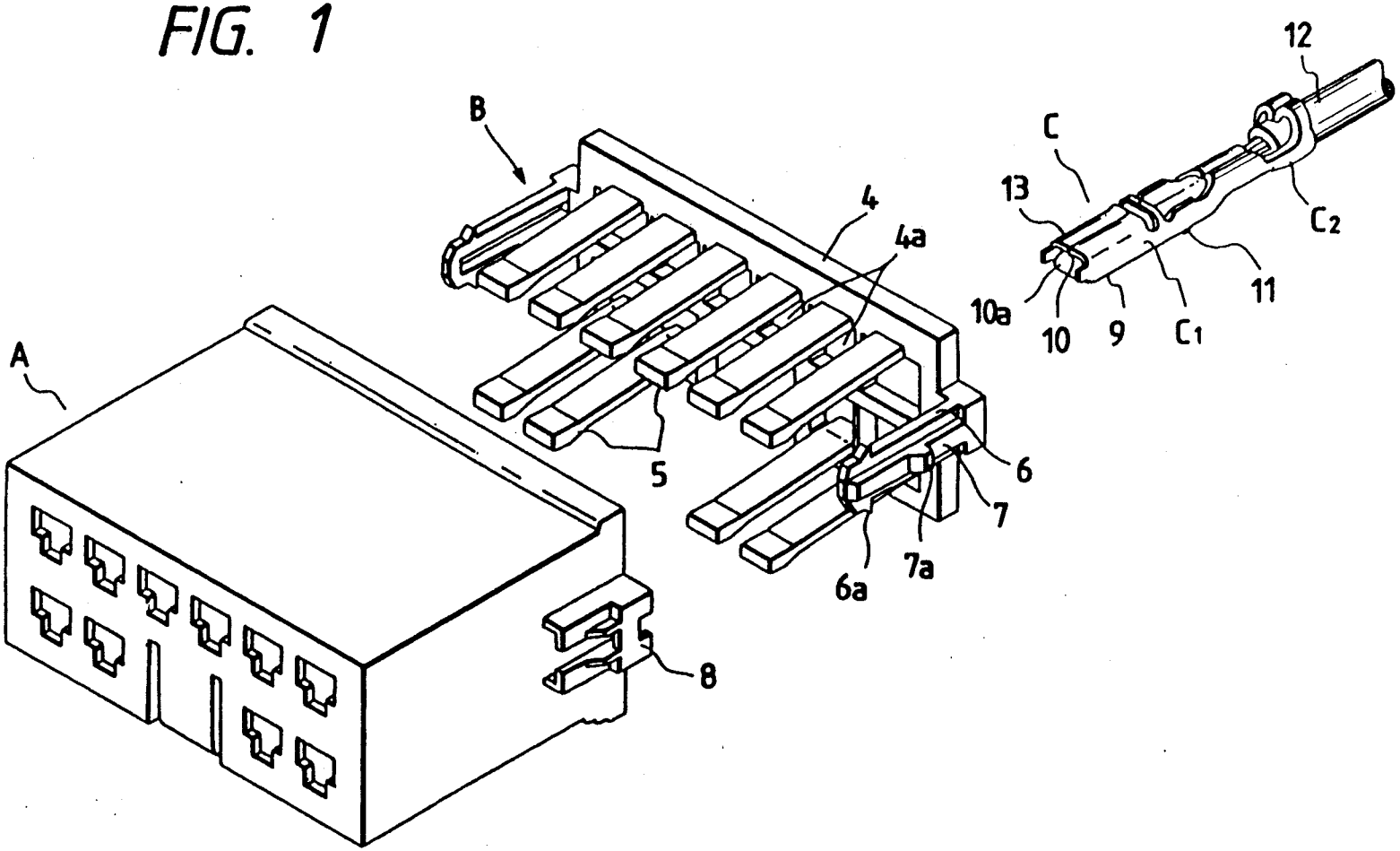
FIG. 1 is an exploded perspective view showing an example of a connector, which constitutes a first embodiment of this invention.
Figure 2:
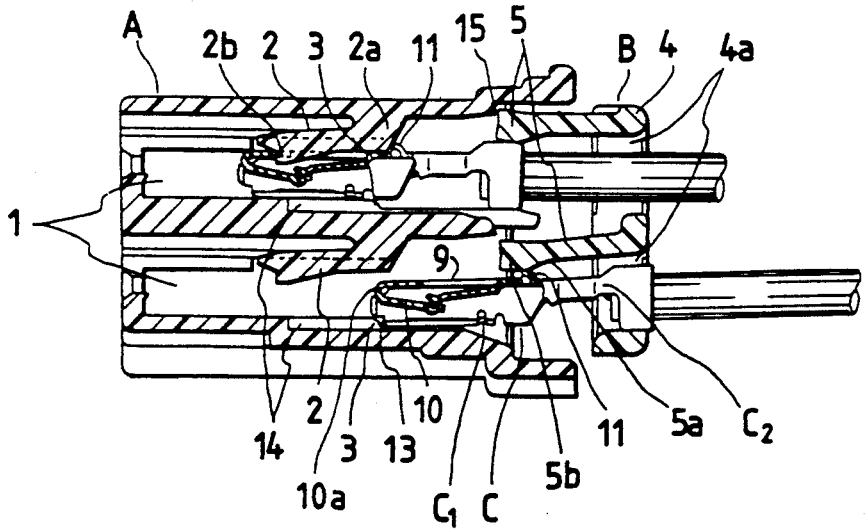
FIG. 2 is a sectional view showing a terminal locking member temporarily engaged with a connector housing in the connector shown in FIG. 1.

An example of a connector, a first embodiment of this invention, is as shown in FIGS. 1 and 2. In FIGS. 1 and 2, reference character A designates a connector housing; B, a terminal locking member; and C, a metal terminal.

The connector housing A has a plurality of terminal accommodating chambers 1. In each of the terminal accommodating chambers 1, a first flexible locking piece 2 is extended forwardly from its one inner wall, and a locking step 3 is formed on the other inner wall opposite to the one inner wall. The base end portion of the first flexible locking piece 2 is formed into a rising base portion 2*a* which is joined to the inner wall, and the front end portion is formed into a locking portion 2*b* which is engaged with the metal terminal C.

The terminal locking member B comprises: a main frame 4 with insertion holes 4*a* in correspondence to the terminal accommodating chambers 1; and second flexible locking pieces 5 extended forwardly from the main frame 4. Each of the flexible locking pieces 5 includes a tapered guide portion 5*a* and an enlarged end portion 5*b*.

Two temporary locking pieces 6 each having a temporary locking protrusion 6*a*, and two final locking pieces 7 each having a final locking protrusion 7*a* are provided on both sides of the main frame 4 of the terminal locking member B. These locking pieces 6 and 7 are engaged with locking portions in locking frames 8 formed on the connector housing A.

The metal terminal C comprises an electrical contact portion $C_1$ and a wire connecting portion $C_2$. The electrical contact portion $C_1$ is made up of a bottom portion 9, an arcuately bent portion 10*a* extended from the bottom portion 9, and an elastic contact piece 10 extended from the arcuately bent portions 10*a*. The electrical contact portion further comprises a protrusion 11 extended at the rear end of the bottom portion 9. The protrusion 11 is to prevent the metal terminal from being inserted upside down by error (hereinafter referred to as "an inverted insertion preventing protrusion 11", when applicable).

Under the condition that the terminal locking member B is temporarily engaged with the connector housing A (as shown in FIG. 2), the metal terminal C connected to a wire 12 is inserted into the terminal accommodating chamber 1 through the insertion hole 4*a* of the main frame 4. If, in this operation, the metal terminal C is in an upside down posture, then as shown in the lower half of FIG. 2 the electrical contact portion C is pushed downwardly in the terminal accommodating chamber 1 by the enlarged end portion 5*b* of the second flexible locking piece 5, so that the front end 13 of the electrical contact portion $C_1$ is abutted against the locking step 3; that is, the difficulty is eliminated that the metal terminal is inserted upside down.

In the case where the metal terminal is correctly inserted, the electrical contact portion $C_1$ is moved into the terminal accommodating chamber 1 passing over the locking step 3 readily because the elastic contact piece 10 has the arcuately bent portion 10*a* at the end.

In the case where the locking step 3 is broken by an external force, as shown in the upper half of FIG. 2 the inverted-insertion preventing protrusion 11 of the metal terminal C is caused to strike against the rising base portion 2*a* of the first flexible locking piece, thus preventing the metal terminal from being inserted upside down.

In this operation, the enlarged end portion 5*b* of the flexible locking piece 5 of the terminal locking member 5 is caused to ride on the metal terminal C; that is, it does not lock the latter C; however, the enlarged end portion 5*b* is confronted with the step 15 of the connector housing A, thus preventing the terminal locking member B from being finally engaged with the connector housing A.

Figure 3:
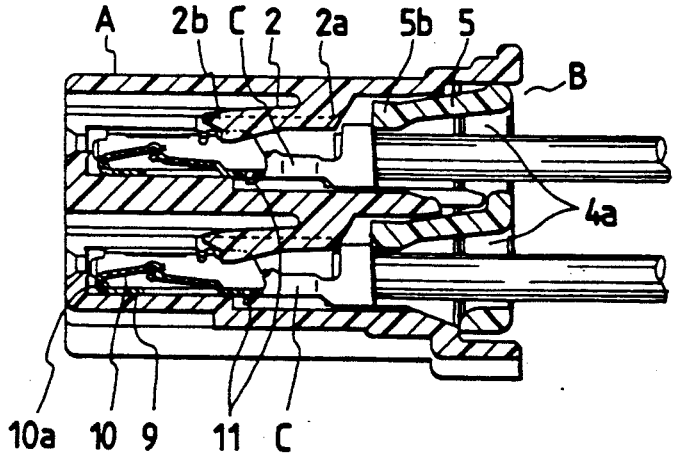
FIG. 3 is a sectional view showing the terminal locking member completely engaged with the connector housing in the connector.

In the case where the metal terminal C is inserted correctly, the inverted-insertion preventing protrusion 11 is engaged with a groove 14 formed in the terminal accommodating chamber 1, so that the locking portion 2*b* of the first flexible locking piece 2 is engaged with the rear end of the electrical contact portion $C_1$, thus preventing the metal terminal C from being unintentionally removed from the connector housing. Under this condition, the terminal locking member B is pushed so as to be finally engaged with the connector housing. As a result, the enlarged end portion 5*b* of the second flexible locking piece 5 is engaged with the rear end of the wire connecting portion $C_2$, thus additionally locking the metal terminal C, as shown in FIG. 3.

Figure 4:
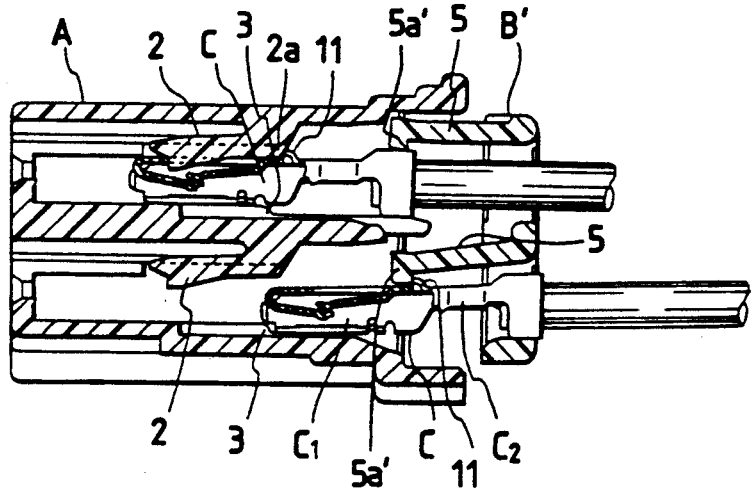
FIG. 4 is a sectional view showing one modification of the connector.

FIG. 4 shows one modification of the connector described above. In the modification, the end portion of a second flexible locking piece 5 of a terminal locking member B' is formed into a locking protrusion 5*a*'. In the case where the metal terminal C is inserted upside down as shown in the lower half of FIG. 4, the inverted-insertion preventing protrusion 11 of the electrical contact portion $C_1$ of the metal terminal C is engaged with the engaging protrusion 5*a*', thus preventing the further insertion of the metal terminal C.

Furthermore, similarly as in the above-described first embodiment, both the locking step 3 and the rising base portion 1*a* prevent the metal terminal from being inserted upside down.

As was described above, the connector of the invention comprises: the connector housing including the terminal accommodating chambers each of which has the first flexible locking piece for the respective metal terminal; and the terminal locking member which is temporarily engaged with the connector housing and then completely engaged with the connector housing, and which has the second flexible locking pieces provided for locking the metal terminals in the terminal accommodating chambers, respectively. The free end portion of each of the second flexible locking pieces is formed into the locking protrusion which is engaged with the inverted-insertion preventing protrusion of the metal terminal. The second flexible locking piece pushes the metal terminal against the wall of the terminal accommodating chamber, to cause the end portion of the metal terminal to abut against the locking step of the wall of the terminal accommodating chamber. Owing to this structure, it is unnecessary to prevent the metal terminal from being upside down inserted at the insertion hole of the terminal locking member; that is, the internal construction of the connector effectively eliminates the difficulty that the metal terminal is inserted upside down.

Another example of the connector, a second embodiment of the invention, will be described with reference to FIGS. 5 through 8.

Figure 5:
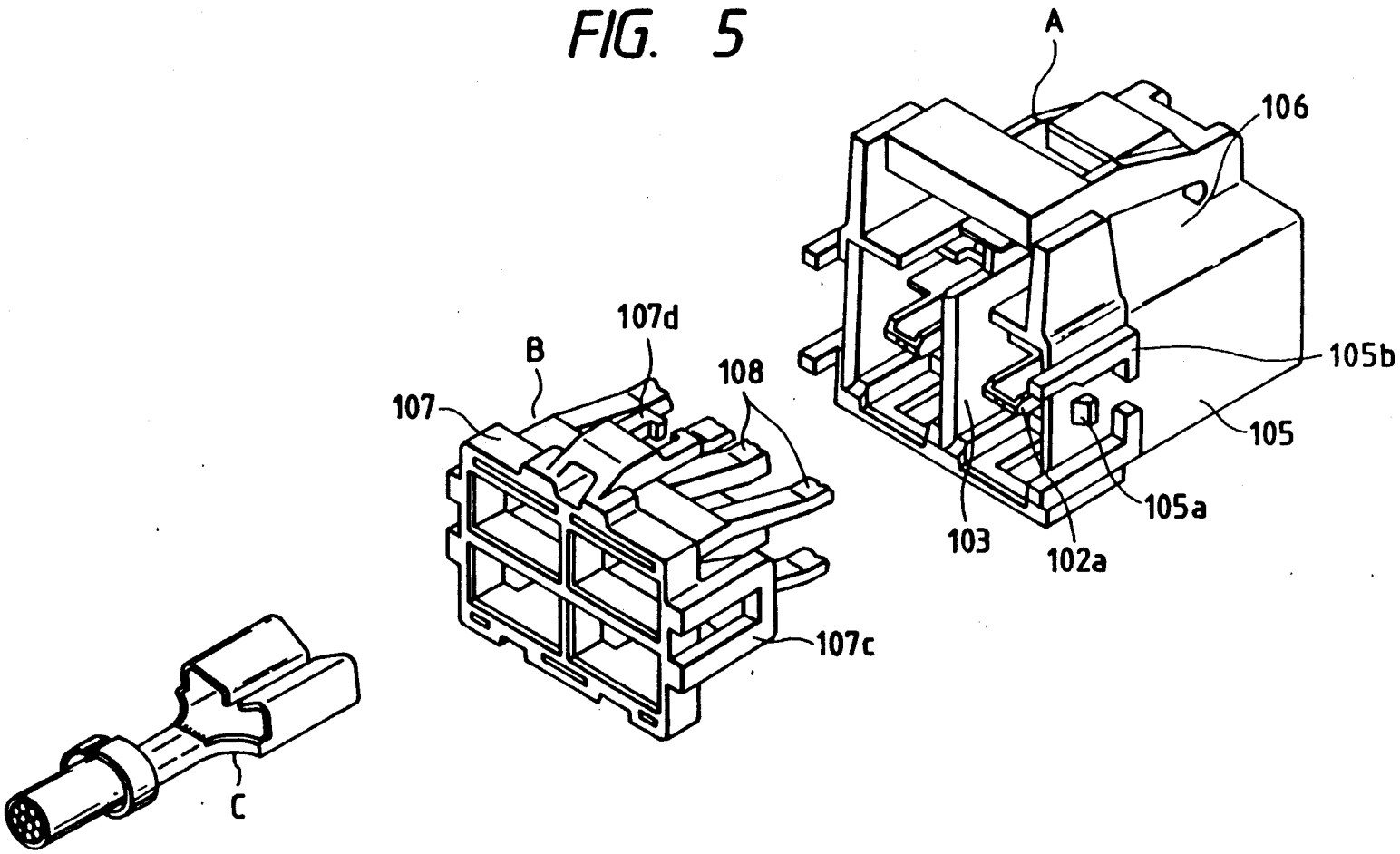
FIG. 5 is an exploded perspective view showing another example of the connector, which constitutes a second embodiment of the invention.

In FIG. 5, reference character A designates a connector housing made of synthetic resin; B, a terminal locking member of synthetic resin; and C, a metal terminal connected to an electrical wire.

Figure 6:
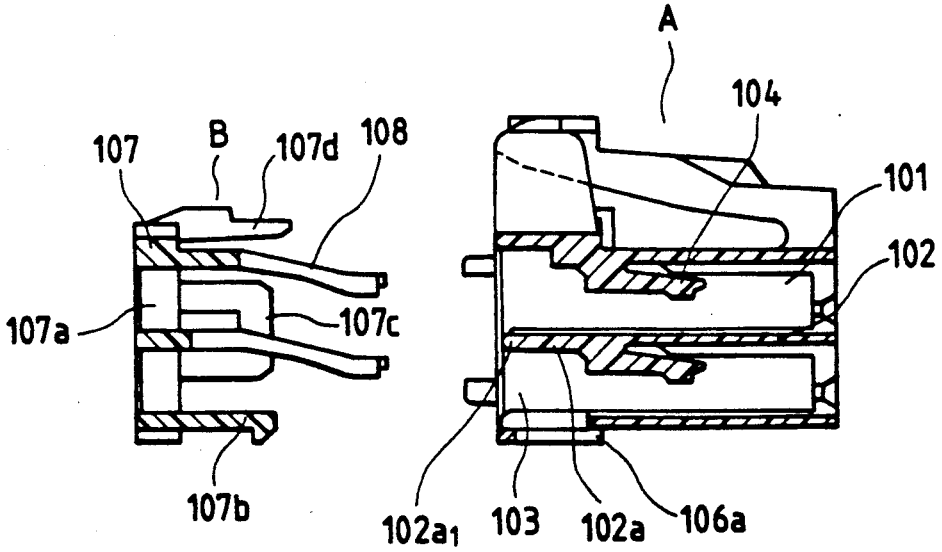
FIG. 6 is a longitudinal sectional view of a connector housing and a terminal locking member in the connector shown in FIG. 5.

The connector housing includes a plurality of terminal accommodating chambers 101 which are defined by a horizontal partition wall 102 and a vertical partition wall 103. Each of the terminal accommodating chambers 102 has a flexible locking piece 104. The connector housing A has two side walls, on each of which a final engaging protrusion 105*a* and a final engaging frame 105*b* are provided. As shown in FIG. 6, a tongue-shaped terminal guide piece 102*a* is formed on the horizontal partition wall 102 at the middle which separates the upper and lower terminal accommodating chambers in such a manner that it is extended axially. More specifically, the end $102a_1$ of the terminal guide piece 102*a* is substantially at the inlet of the connector housing A. The connector housing A has upper and lower walls 106. A temporary engaging hole 106*a* is formed in the lower wall 106*a* of the connector housing A.

The terminal locking member B has a frame 107, which includes a plurality of insertion holes 107*a* in correspondence to the above-described terminal accommodating chambers 101. The terminal locking member B has flexible terminal retaining pieces 108 on one side of the insertion holes 107*a*. A temporary locking piece 107*b* is formed on the lower wall of the frame 107. The temporary locking piece 107*b* and the above-described temporary engaging hole 106*a* of the connector housing A form locking means. A final locking piece 107*c* is formed on each of the outer surfaces of two side walls of the frame 107. The final locking pieces 107*c* and the above-described final engaging protrusions 105*a* of the connector housing A form locking means. Another final locking piece 107*d* is formed on the outer surface of the upper wall of the frame 107. The final locking piece 107*d* and a final locking pawl (not shown) formed on the upper wall of the connector housing A form locking means.

Figure 7:
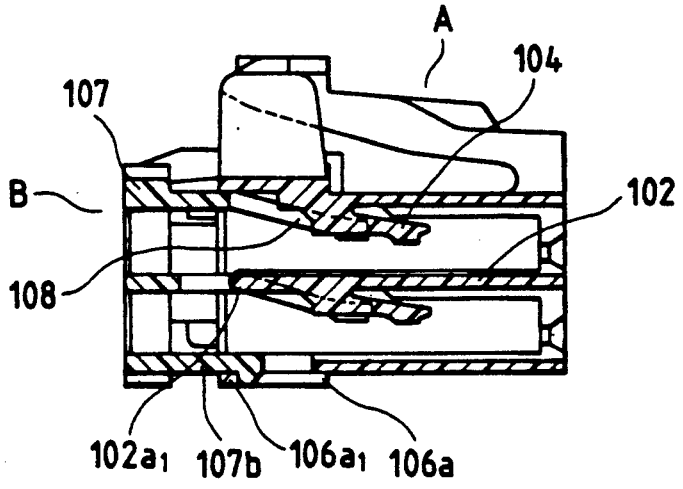
FIG. 7 is also a longitudinal sectional view showing the terminal locking member temporarily engaged with the connector housing.
Figure 8:
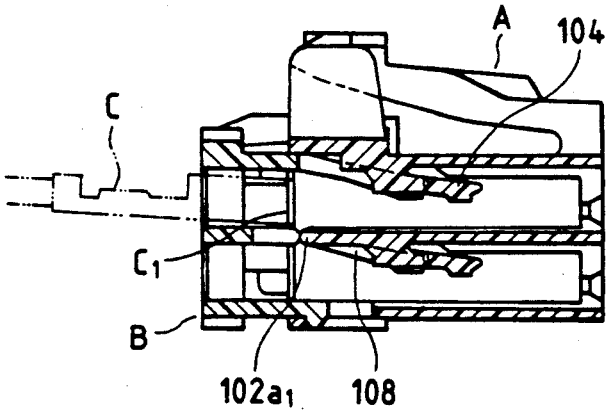
FIG. 8 is also a longitudinal sectional view showing the insertion of a metal terminal with the terminal locking member temporarily engaged with the connector housing as shown in FIG. 7.
Figure 9:
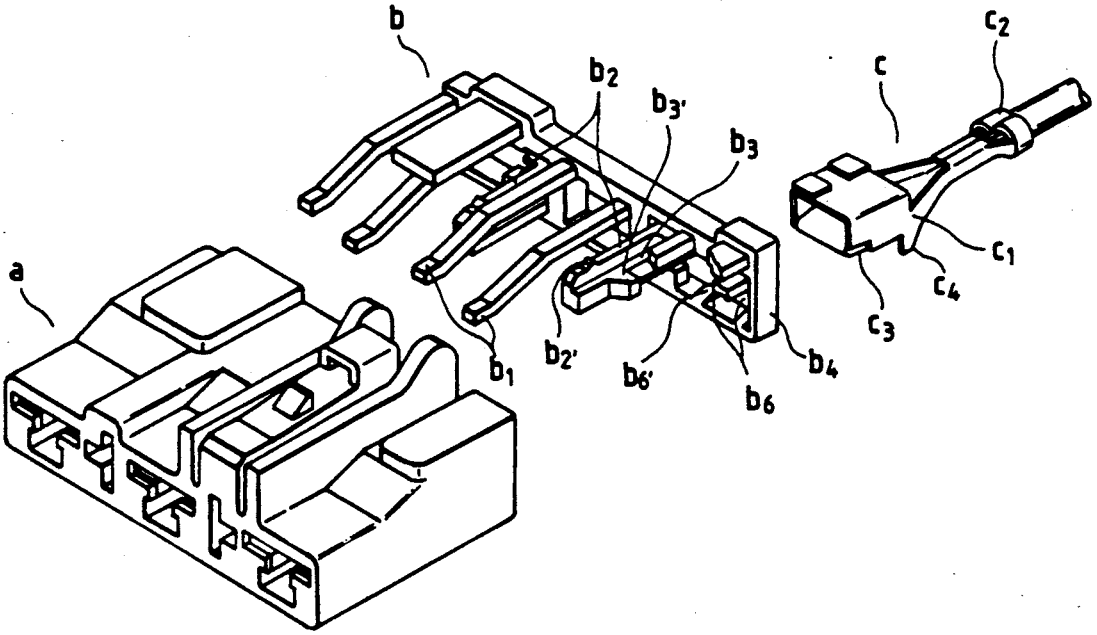
FIG. 9 PRIOR ART
FIG. 9 is an exploded perspective view showing an example of a conventional connector.
Figure 10:
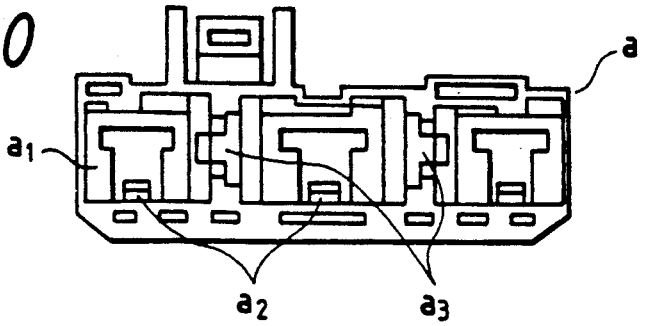
FIG. 10 PRIOR ART
FIG. 10 is a rear view of a connector housing in the conventional connector.
Figure 11:
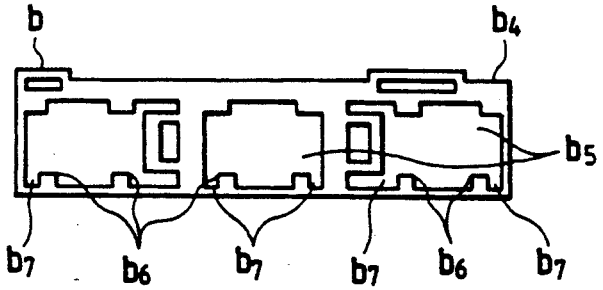
FIG. 11 PRIOR ART
FIG. 11 is a rear view of a terminal locking member in the conventional connector.
Figure 12:
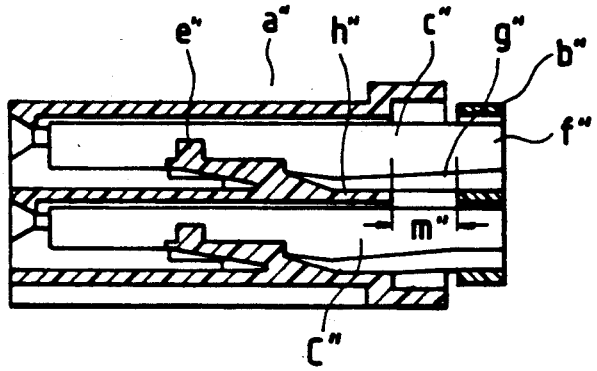
FIG. 12 PRIOR ART
FIG. 12 is a longitudinal sectional view showing the terminal locking member temporarily engaged with the connector housing in the conventional connector.
Figure 13:
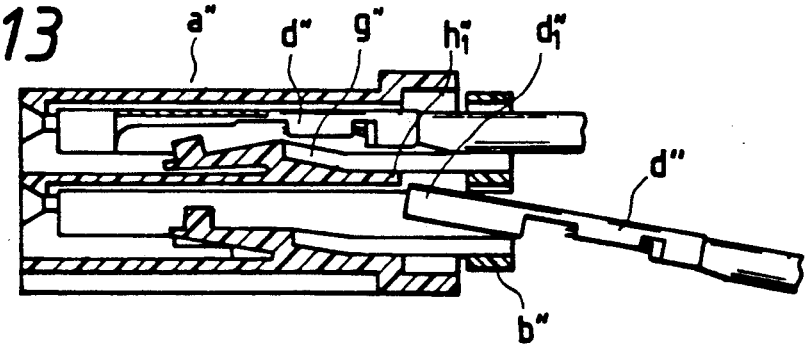
FIG. 13 PRIOR ART
FIG. 13 is a longitudinal section view showing the insertion of a metal terminal with the terminal locking member temporarily engaged with the connector housing as shown in FIG. 12.

The connector housing A and the terminal locking member B manufactured separately are combined as follows: That is, as shown in FIG. 7, the terminal locking member B is temporarily engaged with the connector housing A. In this operation, the temporary locking piece 107*b* is engaged with the temporary engaging hole 106*a* formed in the lower wall of the connector housing A, thus being temporarily locked to the edge $106a_1$ of the temporary engaging hole 106*a*.

Under this condition, the metal terminal C is inserted into the connector. Even if the metal terminal C is held slightly inclined, the end portion $C_1$ of the metal terminal C is smoothly inserted into the terminal accommodating chamber 101 being guided by the end 102$a_1$ of the terminal guide piece 102*a*. When the metal terminal has been inserted into the terminal accommodating chamber, the terminal locking member B is pushed into the connector housing, until the former is completely combined with the latter.

As was described above, the connector, the second embodiment of the invention, is made up of the connector housing with the terminal accommodating chambers, and the terminal locking member having the terminal retaining pieces which are inserted into the terminal accommodating chambers. The terminal locking member is engaged with the rear end portions of the connector housing in two steps, temporarily and finally. The terminal guide pieces are formed on the horizontal partition walls defining the upper and lower terminal accommodating chambers in such a manner that the terminal guide pieces are extended axially. When the terminal locking member is temporarily engaged with the connector housing, each terminal guide piece acts to guide the metal terminal into the terminal accommodating chamber, and therefore the metal terminal can be smoothly inserted into the terminal accommodating chamber in the connector housing. It is understood that the two embodiments discussed above may be combined in a single connector.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A connector comprising:

a metal terminal having an inverted insertion preventing protrusion between the front and rear ends thereof;

a connector housing including a plurality of terminal accommodating chambers each of which has a first flexible locking piece for locking said metal terminal; and a terminal locking member engaged with said connector housing and movable between a temporary position and a final position, said terminal locking member having second flexible locking pieces provided for locking said metal terminals in said terminal accommodating chambers, respectively, wherein each of said second flexible locking pieces has a locking protrusion at the free end, and wherein when said locking member is in said temporary position said locking protrusion engages with said inverted insertion preventing protrusion when said metal terminal is inserted upside down to prevent said metal terminal from being fully inserted within said connector housing.

2. A connector comprising:

a metal terminal a connector housing including a plurality of terminal accommodating chambers each of which has a first flexible locking piece for locking said metal terminal and a locking step portion formed on the wall thereof; and a terminal locking member engaged with said connector housing and movable between a temporary position and a final position, said terminal locking member having second flexible locking pieces for locking said metal terminals in said terminal accommodating chambers, respectively, wherein each of said second flexible locking pieces are adapted to push said metal terminal against the wall of said terminal accommodating chamber, to cause the front portion of said metal terminal to abut against said locking step portion, when said metal is inserted upside down to prevent said metal terminal from being fully inserted within said connector housing.

3. A connector according to claim 2, wherein said metal terminal has an inverted insertion preventing protrusion and said first flexible locking piece has a base portion, said base portion, when said metal terminal is inserted upside down, being abutted against said inverted insertion preventing protrusion, with said metal terminal being free from said second flexible locking piece.

4. A connector according to claim 2, wherein said metal terminal has an inverted insertion preventing protrusion and each of said second flexible locking pieces have a locking protrusion at the free end, said locking protrusion being engaged with said inverted insertion preventing protrusion when said metal terminal is inserted upside down.

5. A connector according to claim 3, wherein each of said second flexible locking pieces have a locking protrusion at the free end thereof, said locking protrusion being engaged with said inverted insertion preventing protrusion, when said metal terminal is inserted upside down.

6. A connector according to any of claims 3, 4, and 5 wherein said connector housing has an engaging groove for being engaged with said inverted insertion preventing protrusion when said metal terminal is correctly inserted into said connector housing.

7. A connector comprising:

a metal terminal having an inverted insertion preventing protrusion;

a connector housing including a plurality of terminal accommodating chambers each of which has a first flexible locking piece for locking said metal terminal, said first flexible locking piece having a base portion; and a terminal locking member movably engaged with said connector housing in two steps, temporarily and finally, said terminal locking member having second flexible locking pieces for locking said metal terminals in said terminal accommodating chambers, respectively, wherein said base portion, when said metal terminal is inserted upside down, in abutted against said inverted-insertion preventing protrusion, with said metal terminal being free from said second flexible locking piece to prevent said metal terminal from being fully inserted within said connector housing.

* * * * *